US005358626A

United States Patent [19]

Gandman et al.

[11] Patent Number: 5,358,626

[45] Date of Patent: Oct. 25, 1994

[54] METHOD FOR RETARDING CORROSION AND COKE FORMATION AND DEPOSITION DURING PYROLYTIC HYDROCARBON PROCSSING

[75] Inventors: Zalman E. Gandman; Hong K. Jo, both of Placentia, Calif.

[73] Assignee: Tetra International, Inc., Brea, Calif.

[21] Appl. No.: 103,291

[22] Filed: Aug. 6, 1993

[51] Int. Cl.[5] ..... C10G 9/00

[52] U.S. Cl. ..... 208/48 R; 208/48 AA; 208/47; 585/650; 585/950

[58] Field of Search ..... 208/48 R, 48 AA, 48 Q, 208/120, 47; 585/649, 650, 950

[56] References Cited

U.S. PATENT DOCUMENTS

| | | | |
|---|---|---|---|
| 2,893,941 | 7/1959 | Kohlfeldt et al. | 208/48 Q |
| 3,617,478 | 11/1971 | King, Jr. et al. | 208/48 AA |
| 4,555,326 | 11/1985 | Reid | 208/48 R |
| 4,680,621 | 7/1987 | Forester et al. | 208/48 AA |
| 4,889,614 | 12/1989 | Forester | 208/48 AA |

FOREIGN PATENT DOCUMENTS

| | | |
|---|---|---|
| 1234205 | 2/1967 | Fed. Rep. of Germany . |
| 1497055 | 10/1966 | France . |
| 2408644 | 6/1979 | France . |
| 191726 | 3/1967 | U.S.S.R. . |

OTHER PUBLICATIONS

Muchina, T. H. et al, *Pyrolysis Hydrocarbons,* Moscow Chemical, 1987, p. 92.

*Primary Examiner*—Helen M. S. Sneed
*Assistant Examiner*—Bekir L. Yildirim
*Attorney, Agent, or Firm*—Harness, Dickey & Pierce

[57] ABSTRACT

Coke formation and coil corrosion in pyrolysis furnaces is controlled by adding a mixture of a Group IA metal salt, a Group IIA metal salt and a boron acid or salt thereof to the hydrocarbon feedstock for the pyrolysis furnace.

32 Claims, 1 Drawing Sheet

METHOD FOR RETARDING CORROSION AND COKE FORMATION AND DEPOSITION DURING PYROLYTIC HYDROCARBON PROCSSING

FIELD OF THE INVENTION

This invention relates to methods of inhibiting coke or carbon formation and the corrosion on the metal surfaces of processing equipment during high temperature processing or cracking of hydrocarbons by the addition of additives to the hydrocarbon feedstream to be reacted. More particularly, this invention relates to the addition of relatively small amounts of a mixture consisting of Groups IA and IIA metal salts and a boron compound selected from boric acid and the salts of boron acids, and optionally a silicon compound, to the feedstream to be reacted.

BACKGROUND OF THE INVENTION

In conventional pyrolysis processes using pyrolysis furnaces, reaction mixtures of feed hydrocarbons and steam flow through long coils or tubes which are heated by combustion gases to produce ethylene and other olefins, as well as other valuable by-products. The combustion gases are produced from natural or pyrolysis gases or fuel oils and air. The hot combustion gases are passed around the coils, counter-current to the hydrocarbon feedstock flow through the coil. Heat is transferred from the hot combustion gases to the walls of the tubes and then coil walls to the hydrocarbon feedstock passing within the coils. The hydrocarbon feedstock is heated within the coils from about 100° C. to higher temperatures, typically in the range of about 750° to 950° C. in the last few years, there has been a trend to heat the hydrocarbon feedstock to the higher temperatures in order to obtain increased amounts of ethylene production per given amount of feed.

Unfortunately coke is always produced as a reaction by-product and collects on the coil inner walls, and the high operating temperatures tend to promote or increase this phenomenon. Coke formation has several deleterious effects including the following:

(a) Coke formation on the inner walls of the coil results in increased resistance to heat transfer to the hydrocarbon feed. Thus, a smaller fraction of the heat of combustion is transferred to the hydrocarbon feed and a larger fraction of the combustion gas heat is lost to the surroundings in the stack gas.

(b) Due to the increased resistance to heat transfer, the temperature of the wall of the coil must be heated to even higher temperatures to adequately heat the hydrocarbon feed within the coil. This results in increased corrosion of the coil walls and a shorter life for the expensive high-alloy coils.

(c) The coke build-up in the coil results in larger pressure drop for the hydrocarbon feed flowing through the coils, since the flow path is more restricted. As a consequence, more energy is required to compress the hydrocarbon product stream in the downstream portion of process.

(d) The coke build-up in the coil restricts the volume in the reaction zone, thereby decreasing the yield of ethylene and other valuable by-products. Hence, more hydrocarbon feedstock is needed to produce the required amounts of product.

Coke formation is also a problem in transfer line exchangers (often referred to as TLX's, TLE's, or quench coolers). The objective of a TLX is to recover as much of the sensible heat as possible from the hot product stream leaving the pyrolysis furnace. This product stream contains steam, unreacted hydrocarbons, and the desired products and by-product. High-pressure steam is produced as a valuable by-product in the TLX, and the product mixture is cooled appreciably. As in the coil of the pyrolysis furnace, coke formation and/or collection in the TLX results in poorer heat transfer, which in turn results in decreased production of high-pressure steam. Coke formation in the TLX also results in a larger pressure drop for the product stream.

In current pyrolysis furnaces, coke formation in the pyrolysis coils and/or in the TLX eventually becomes so great that the coils and/or the TLX must be cleaned.

Although various cleaning techniques have been suggested or tried, the pyrolysis unit is usually shut down (i.e., the feedstream flows are suspended). The flow of steam, however, is generally continued since steam reacts slowly with the deposited coke to form gaseous carbon oxides and hydrogen.

Moreover, air is often added to the steam. At the high temperatures in the coil, the coke in the coil reacts quite rapidly with the oxygen in the air to form carbon oxides. After several hours, the coke in the coil is almost completely removed. This cleaning step is frequently referred to as "De-coking." The coke in the TLX is not as easily removed or gasified, however, due to the lower temperatures in the TLX as compared to the coil.

Cleaning or de-coking of the TLX is, thus, often accomplished by mechanical means. Certain mechanical de-coking means have also been used or can be used for cleaning the coil.

De-cokings frequently require at least one day and sometimes two days in conventional units, de-cokings are made approximately every 30 to 60 days. De-coking obviously results in increased downtime relative to ethylene production time, frequently amounting to a several percent loss of ethylene production during the course of a year. De-coking is also relatively expensive and requires appreciable labor and energy.

In 1992, almost 42 billion pounds of ethylene were produced in the U.S., primarily by the above-described process. It is anticipated that this will increase to about 49 billion tons by 1998. In the Pacific rim countries, about 7 billion pounds of ethylene were produced in 1992, primarily by the above-described process. It is anticipated that production will increase to 40 billion tons by the year 2000. A method to extend the time between de-cokings is highly desirable.

Numerous suggestions have been made as to how to eliminate or minimize coke formation in ethylene pyrolysis units. For example, improved control of the operating conditions or improved feedstock quality has resulted in small decreases in the rate of coke formation. The cost of making such changes, however, is often high so that these changes are frequently not cost effective.

Several processes have been reported in which various additives claimed to be either inhibitors or catalysts are added to the hydrocarbon-steam feed stream. If the additive is an inhibitor, coke (or carbon) formation is inhibited, or minimized. If the additive is a catalyst, reactions between the coke and steam are presumably promoted, or catalyzed. In such a case, the formation of carbon oxides (CO or $CO_2$) and hydrogen are promoted. In either case, the net rate of coke that collects on the metal surfaces is decreased.

Sulfur, an additive, has been proposed to reduce coke formation in Great Britain Patent No. 1,090,933, German Patent No. 1,234,205 and French patent No. 1,497,055. At the least, part of the beneficial effect of sulfur is generally considered to be caused by conversion of metal oxides on the inner surfaces of the coil walls to metal sulfides. The metal sulfides tend to destroy the catalytic effect of metal oxides which promote coke formation. Although sulfur may act as an inhibitor, it also frequently promotes the destruction of the coil metal walls because the metal's corrosion resistant, protective oxide layer has been replaced by metal sulfides which tend to flake off or be lost from the surface. Moreover, at high temperatures, some sulfides, such as nickel sulfide, liquify.

Other additives reported include phosphorous pentoxide (see L. M. Aserizzi, J. Hydrocarbon Processing, 1967, Vol. 46, pg. 4) and ammonium nitrate (see U.S.S.R. Patent No. 191,726). These latter compounds obviously break down at the high temperatures and oxides of nitrogen are likely to form.

Potassium carbonate has also been proposed as a feedstream additive in U.S. Pat. No. 2,893,941 to Kohfeldt and Herbert. In using such an additive, provisions must be made to introduce a relatively small but equal amount of the salt to each of several coils in a pyrolysis furnace. One method is to add an aqueous solution of the salt in measured amounts into the feedstream of each pyrolysis unit. As the potassium carbonate is heated in the coil to the pyrolysis temperatures, part or all of its apparently decomposes, perhaps forming $K_2O$, and part deposits on the coke present on the walls. Such deposits apparently catalyze the gasification between coke and steam so that at typical pyrolysis conditions the net formation of coke on the surfaces of the coils is low if not essentially zero. Corrosion on the inner surface of the coil has been found to be a problem in the process described in U.S. Pat. No. 2,893,941. Although details on what causes corrosion in this process are not known, solid deposits resulting from the potassium carbonate are known to sometimes occur, especially if the quantity of the carbonate added is not controlled correctly. Such deposits may cause intercrystalline cracking on the metal surface. Tests have been made in commercial units to find operating conditions in which corrosion is not a problem. Adding various levels of potassium carbonate and different concentrations of solutions were, for example, investigated, but no suitable set of operating conditions was found. No conditions were found which resulted in both coke-free surfaces and minimal corrosion.

U.S. Pat. No. 4,889,614 to Forester has reported a method for reducing coke formation using magnesium acetate, magnesium nitrate, calcium acetate, calcium nitrate, or calcium chloride as an additive. He investigated all six salts and found that the rate of coke formation on stainless steel surfaces was reduced in the temperature range of 1400° to 2050° F. Such a temperature range is used in all, or at least most, commercial pyrolysis units. He reported the percent reduction in the rates of coke formation or deposition based on numerous runs made with and without the use of one of the salts. He found, however, that corrosion of stainless steel was a major problem. Small, but significant, amounts of $Fe_3O_4$, $NiO_2$, $Cr_2O_3$, and $MnO_2$ were present in the coke. The laboratory coil had to be replaced after 20–30 laboratory runs, which were normally 160 minute runs.

The process described in U.S. Pat. No. 4,889,614 is apparently considerably less effective in removing or minimizing coke deposition as compared to the process of U.S. Pat. No. 2,893,941. For example, calcium acetate resulted in a coke reduction of only 24% (see Table II of the '614 patent), although somewhat higher reductions occurred with magnesium nitrate and magnesium sulfate. Moreover, based on the results reported, corrosion would be so severe that the process would likely be of no commercial interest. There is also no indication that the process would be effective in minimizing coke formation in the TLX, which operates at much lower temperatures than the coils.

In conclusion, no satisfactory method has to date been reported using additives for controlling coking problems. Those processes that did control the coking problems resulted in major disadvantages that rendered the process economically unfeasible.

SUMMARY OF THE INVENTION

In view of the foregoing, it is readily apparent that the prior art has various undesirable drawbacks. In contrast, the present invention has resulted in major improvements. Advantages of the present invention includes all of the following:

(a) Increased levels of production of lower olefins, including both ethylene and propylene.

(b) Time of operation between de-coking is substantially lengthened and maintenance problems reduced.

(c) Coke build-up in both the pyrolysis coils and TLX's is reduced. In many cases, essentially no coke accumulates in the coil, resulting in more uniform and more stable operation during the entire pyrolysis cycle. Otherwise, as coke is deposited, small but significant changes in operation are normally required.

(d) Economically speaking, energy requirements are reduced, including lower fuel requirements for pyrolysis furnaces, greater steam production from TLX's, and lower energy requirements for compressors.

(e) The expensive high-alloy steel coils in the pyrolysis furnace and the TLX's are replaced less frequently.

(f) Flexibility to use different hydrocarbons as feedstock is increased.

All of these advantages have been achieved by introducing a mixture of additives to the hydrocarbon feedstream of the pyrolysis furnace in amounts effective to maintain corrosion passivation on the internal wall surfaces of the furnace coil while reducing the coke deposition on the internal wall surfaces of the coil.

The present invention is directed to a method for inhibiting the formation and deposition of coke on the inner wall of the coil of a pyrolysis furnace having a radiation stage and a convection stage during high temperature processing of hydrocarbon feedstock for the production of alkylenes while minimizing corrosion of the internal wall surface of the coil which comprises: adding to the hydrocarbon feedstock in the coil at the end of the convection stage of the pyrolysis furnace a mixture of a Group IAa metal salt, a Group IIa metal salt and a boron acid or salt thereof, and to the mixture used in the method.

Preferably the hydrocarbon feed has a temperature below the pyrolysis temperature when the mixture is introduced to the feed. About 0.1 to about 150 parts per million (ppm) by weight of the Group IIA metal in the mixture is introduced to the hydrocarbon feedstock. Most preferably, about 0.5 to about 100 ppm by weight of the Group IIA metal in the mixture is added to the hydrocarbon feedstock. The elemental weight ratio of the Group IA metal to the Group IIA metal in the mixture is preferably from about 0.001 to about 5.0. Most preferably the elemental weight ratio of the Group IA metal to the Group IIA metal in the mixture is from about 0.007 to about 3.0. The elemental weight ratio of the boron in the boron acid or salt to the Group IA metal and Group IIA metal in the mixture is preferably from about 0.001 to about 5.0. Most preferably the elemental weight ratio of the boron in the boron acid or salt to the Group IA and Group IIA metal in the mixture is from about 0.005 to about 3.0. It is to be noted that these are elemental weight ratios, not salt to salt or acid to salt weight ratios.

The mixture can optionally contain a silicon compound. Silicon compounds that can be employed include the potassium salts of silicic acid, silanes, disilanes, the higher silanes and alkyl and aryl substituted silanes, disilanes and higher silanes. The elemental weight ratio of silicon to the Group IA metal, Group IIA metal and boron is from about 0.001 to about 1.0.

The mixture is preferably dissolved in a solvent and the solvent dissolved mixture is injected into the hydrocarbon feed. The solvent can be water, alcohols, polyols, and hydrocarbons, including the hydrocarbon feedstock. Preferably the mixture is fully dissolved in the solvent. The solvent can contain up to 10 g per liter of solvent of the Group IA metal salt, Group IIA metal salt and boron acid or salt.

Sometimes because of solubility limitations of the salt and/or solvent, only a portion of the mixture at most can be dissolved in the solvent; the remainder of the mixture is finely dispersed as undissolved solids and/or as a separate liquid phase finely dispersed in the solvent.

The amount of mixture injected into the hydrocarbon feedstock is adjusted to a predetermined value to prevent the formation of coke in the coil. Preferably between 0.1 and 500 ppm by weight of elemental Group IA metal, Group IIA metal and boron in the mixture is added to the hydrocarbon feedstock. Preferably the weight ratio is from about 0.1 to about 100 parts by weight of the metals and boron in the mixture per one million parts of the hydrocarbon feedstock. The amount of mixture introduced into the hydrocarbon feedstock is increased when the outer wall temperature (i.e. skin temperature) of the coil in the radiation stage of the pyrolysis furnace increases and/or when the pressure drop in the coil increases.

The hydrocarbon feedstock can be lower alkanes, naphtha, gas oil, heavier oil or mixtures thereof. The hydrocarbon feedstock is often mixed with steam in the convection stage of the pyrolysis furnace.

The Group IA metal salt is preferably potassium carbonate, potassium acetate, potassium metaborate, potassium nitrate, potassium metasilicate, potassium silicotungstate, silicon compounds, such as silanes, disilanes, and potassium salts of silicic acid, or mixtures thereof. The Group IIA metal salt can be calcium or magnesium nitrate, alkanoic acids, or salts of calcium, magnesium or barium, or magnesium, calcium nitrates.

DETAILED DESCRIPTION OF THE INVENTION

Figure 1:
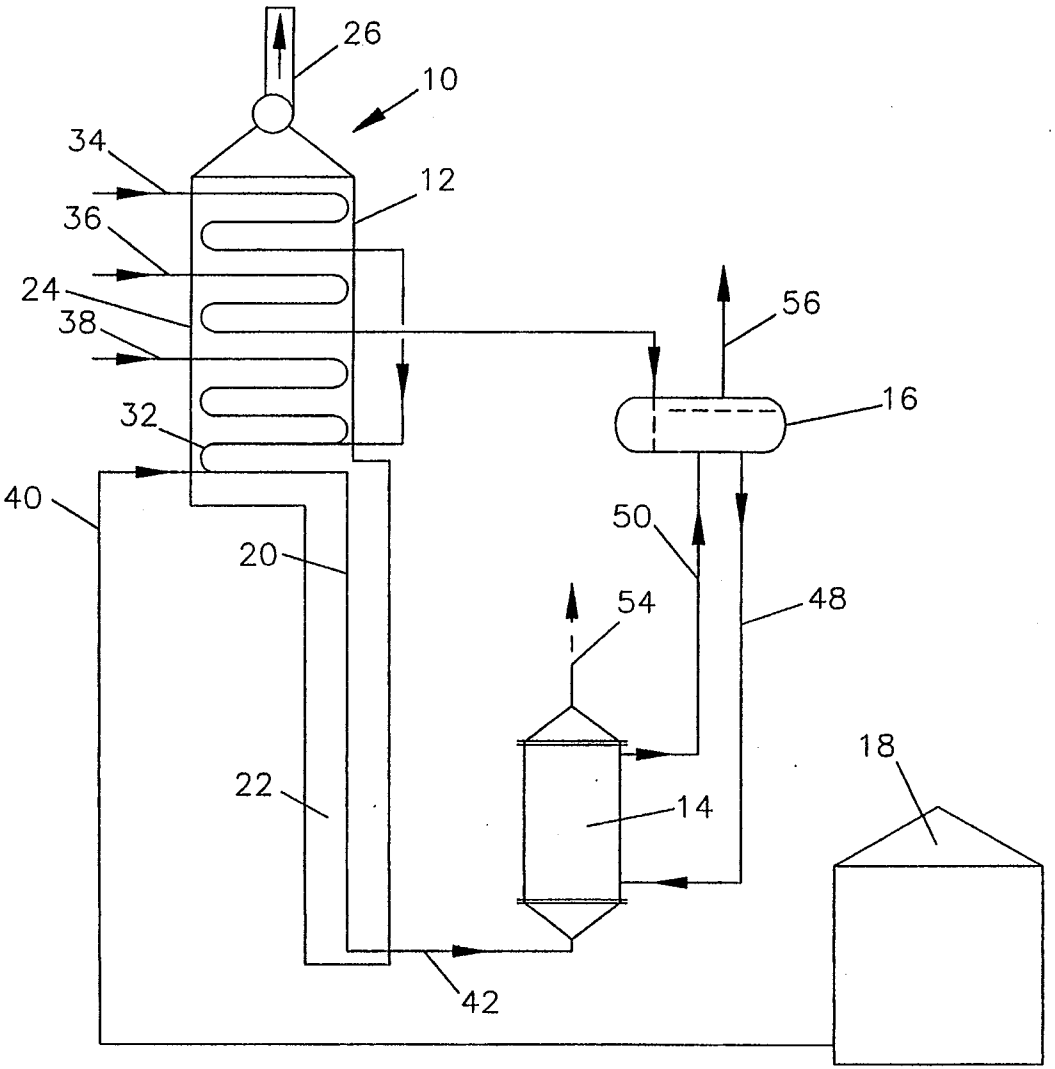

Referring to the drawing, a flow diagram for a pyrolysis unit 10 is shown which comprises a pyrolysis furnace 12, a transfer line heat exchanger (TLX) 14, a steam drum 16, and an additive mixture tank 18. The pyrolysis furnace 12 has a lower radiation stage 22 wherein hot combustion gases are produced or introduced and an upper convection stage 24 which receives hot combustion gases from the radiation stage. The combustion gases exit the furnace via exhaust gas duct 26. A radiation coil 20 is in the radiation stage 22 and constitutes the coil wherein the pyrolysis or cracking reaction occurs. The hydrocarbon feed is preheated to a temperature just below the pyrolysis temperature in a convection coil 32 in the convection stage 24. The hydrocarbon feedstock is fed into the convection coil 32 at inlet 34. A water line 36 extends through the convection stage to the steam drum 16. A steam line 38 passes through the convection stage and is fed into the convection coil 32 upstream from the point where an additive mixture line 40 from the additive mixture tank 18 is connected to the convection coil. The additive mixture line is connected to the convection coil close to the end: of the convection coil.

The radiation coil is connected to a transfer line 42 which passes to the TLX 14. The TLX is cooled by the boiled water from the steam drum 16. Water is circulated from the steam drum through line 48 into the TLX. Hot water from the TLX is returned to the steam drum by outlet line 50. The product exits the TLX through product line 54.

Today, most pyrolysis furnaces, such as the furnaces used in ethylene plants are controlled by computer controls. Such plants are complicated to run and computers can control the hydrocarbon feed rate, the steam feed rate, the coil outlet temperature and coil pressure (pressure drop). The furnace-coil outlet temperature is frequently controlled by manipulating fuel rate to the furnace. The coil outlet pressure is controlled by suction pressure from a cracked gas compressor (not shown) upstream of the product line 54. Furnace and transfer line heat exchanger disturbances can originate with coke lay-down in furnace and the TLX boiler tubes which affect coil pressure, heat transfer ambient temperature and cooling water availability. Temperature restrains the furnace operation because the furnace cannot operate when the coil outlet temperature exceeds a threshold temperature or when the combustion gases exceed the maximum refractory temperature or when the product exiting from the TLX exceeds a threshold temperature or when the tube-skin temperature of the coil exceeds a threshold temperature. These temperature problems are directly related to coke build-up in the coil and the TLX.

In operation, hot combustion gases are fed into the bottom of the radiation stage of a furnace and the combustion gases pass up through the furnace into the convection stage and out the exhaust duct concurrent to hydrocarbon feed. Hydrocarbon feedstock is fed via line 34 into convection coil 32 wherein the hydrocarbon feedstock is preheated before passing into the radiation coil. In the convection stage, steam is normally injected into the feedstock in the coil. Further downstream just before the convection coil enters the radiation stage, in the present invention, an additive mixture is injected into the feedstock via line 40. The reaction mixture of feedstock, steam and additive mixture proceeds down the radiation coil 20 in the radiation stage wherein the hydrocarbon is pyrolized to form unsaturated components, principally ethylene or propylene and by-products. The reaction mixture exits the bottom of the furnace as a product stream into a transfer line 42 which passes into the TLX 14. The product stream is cooled in the TLX by boiled water from the steam drum 16 which is fed through lines 48 into the TLX and fed back to the drum via line 50. The product stream 54 exits the TLX and then can proceed to a fractionater, dryer and the like. High pressure steam heated by the hot water returned from the TLX exits the steam drum via line 56. The water supply furnishing the cooling water for the TLX is supplied through water line 36 which is preheated in the convection stage before it enters the steam drum 16. The steam introduced into the hydrocarbon feedstock and the convection coil is fed through steam line 38 which is superheated in the convection stage. The use of the additive mixture of the present invention minimizes and in many cases inhibits the formation of coke in the coil 20 and in the tubes of the TLX 14. In addition to inhibiting coke formation, the additive mixture is substantially non-corrosive to the inner surface walls of the coil 20 and the TLX tubes. This is a major advantage since the coil is made of expensive high alloy steel.

Groups IA and IIA metal salts for the additive mixture are preferably soluble in solvents. Most preferred are the Group IA and IIA salts that include Group IA and IIA metal salts, boric acid salts and metasilicic acid salts soluble in polar solvents, such as water, alcohol, ethylene glycol, and the like, to the extent of not more than 10 g. per liter of solvent.

The additive mixture can be injected into the feedstock as a solution, either a fully dissolved solution or a partially dissolved solution with finely dispersed undissolved solids. The solid components of the additive mixture can be dissolved or finely dispersed in a wide variety of solvents. Because of the ionic nature of the solid components of the additive mixture, highly polarized solvents, such as water and alcohols are particularly advantageous. Such solvents include water, methyl alcohol, ethyl alcohol, normal and iso-propyl alcohol, normal-, iso- and tert-butyl alcohol, and the like. Higher alkane alcohols can be employed but because of the chain length of the organic portion, they become less polar. Organic polyols can also be employed. The highly polarized polyols are particularly advantageous. Typical polyols include ethylene glycol, propylene glycol, polyols made from ethylene glycol, propylene glycol, and the like. Non-polar and less polar organic solvents may also be employed, such as ketones, such as acetone, diethyl ketone, and the like; ethers, such as dipropyl ether, polyethylene ethers and the like; esters such as ethyl acetate, methyl butanoate and the like; alkanes, such as hexane, octane, cyclohexane, naphtha, fuel oil, kerosene, and the like. Preferably the additive mixture is dissolved into the solvent to obtain a concentration of the Group IIA metal salt in the solvent of not more than 10 g per liter.

Little is known about the catalysis mechanism of Group IIA metal salts in the process of coke gasification. Studies of the reactivity of various calcium compounds such as calcium or magnesium metaborates or alkanoic acid in salts, and calcium, magnesium or barium of metasilic acid salts exhibit the same reactivity with the same percentage ratio of calcium (or Group IIA metal)-to-coke. Calcium compounds break down at a temperature of 500° C. into CaO and other compounds, which again suggests that CaO initiates the process.

The Group IA metal salts are especially active in reducing coke production, especially for the pyrolysis of heavy feed materials such as heavy naphtha and gas oils. The reactivity of the Group IA metal salts during coke gasification is substantially greater than that of the Group IIA metal salts, permitting a reduction in coke formation during pyrolysis of heavy hydrocarbon feed material with relatively small additions of these salts to the additive mixture. The addition of these salts also apparently reduces the formation of coke in the heat exchangers, which considerably increases the operational time of the entire furnace system.

The mixture comprises three active ingredients: a Group IA metal salt, a Group IIA metal salt, and a boron acid or salt. Although any Group IA metal salt may be used, the preferred salts are potassium salts. The potassium acetates, potassium carbonate, potassium silicotungstate, potassium metaborate, metasilicate, potassium tetrasilicate and potassium nitrate salts are especially preferred. Likewise, any Group IIA salt can be employed but calcium, magnesium, beryllium and barium salts are preferred. The anion portion of this salt can be the anion of a strong or weak acid, such as nitric acid, metaboric acid, metasilic acid, or an organic acid, such as acetic acid, propionic acid and the like. The acetate, metaborate, metasilicate salts of magnesium, calcium, beryllium and barium are conveniently used in the present invention. Especially preferred are the solvent soluble alkanoic acid salts of calcium, magnesium, and barium, e.g., calcium acetate, magnesium acetate, barium acetate and the like. The boron acid or salts are orthoboric acid, metaboric acid, tetraboric acid and the polyboric acids, and the ammonium, Group IA metal and Group IIA metal salts of these acids. It may well be that other forms of boron can be utilized in the present method. For example, colemanite, boroxides and the ammonia, Group IA metal and Group IIA metal peroxyborate salts may be utilizable in the present method. Mixtures of Group IA metal salts, Group IIA metal salts and/or boron acids or salts can be employed.

Optionally, a silicon compound can be incorporated into the additive mixture. Sufficient silicon compound is added to have an elemental silicon to Group IA metal, Group IIA metal and boron ratio of about 0.001 to about 1.0 in the additive mixture.

The silicon compound can be selected from a large group of silicon compounds. Conveniently, the potassium salts of silicic acid, a silane or an alkyl and/or aryl substituted silane can be used. By silanes is meant silane, disilane, trisitane, tetrasilane and the higher silanes.

The relative amount of the above metals and, optionally, silicon in the additive mixture with boron salts is preferably adjusted to obtain the desired reduction in coke formation on the metal surfaces and to simultaneously maintain corrosion passivation and maintain low corrosion levels in the coils and TLX tubes.

In the preferred embodiment of the present invention, the elemental weight ratio of the Group IA metal to the Group IIA metal in the mixture is from about 0.001 to about 5.0. An especially preferred elemental weight ratio of the Group IA metal to the Group IIA metal in the mixture is from about 0.007 to about 3.0. The Group IA metal includes both the metal from the Group IA metal salt and the Group IA metal salt of boric acid, if any, and the Group IIA metal includes the metal from the Group IIA metal salt and the Group IIA metal salt of boric acid, if any. In the preferred embodiment of the present invention, the elemental weight ratio of the boron in the boron acid or salt to the Group IA metal and the Group IIA metal in the mixture is from about 0.001 to about 5.0. In an especially preferred embodiment of the present invention, the elemental weight ratio of the boron in the boron acid or salt to the Group IA and Group IIA metal in the mixture is from about 0.005 to about 3.0.

The preferred method of introducing the additive mixture into the hydrocarbon feedstream is to disperse and/or dissolve the additive mixture in polar solvent or non-polar solvent, followed by introduction into the pyrolysis feedstream at an appropriate location upstream of the pyrolysis coils ("pyrocoil" herein).

Concentrations of less than about 1 gram of the additive mixture per liter (1) of solvent (or about 0.1 wt. % additives in the solution) are preferred. The solvent-additive mixture can be prepared in a concentrated form, for example, prepared in a mixer where the concentration of the additive mixture can reach as high as 10% of the total mass of additive mixture and solvent. Subsequently, the concentrate can be fed into a reservoir, where it is mixed with water or other solvent until it reaches, for example, a concentration of about 500–1000 mg/l of solvent for introduction into the furnace. The concentration of the solution is not of key importance except to note that significantly more concentrated solutions, i.e. solutions having more than 10 g. of the additive mixture per liter, have been found to promote corrosion or destruction of the coils. Without being held to any specific theory, apparently dilute solutions act to distribute the additive mixture or the residue of the additive mixture more uniformly on the inner walls of the coil and inner walls of the TLX's.

According to a preferred embodiment of the invention, the solvent-additive mixture is preferably introduced into the pyrolysis feedstock stream by injection into a coil through which the feed mixture flows. As explained earlier, the injection site is preferably located in the convection stage of the pyrolysis furnace about 5–10 meters upstream from the entrance to the pyrolysis coil. This technique was found to be effective in introducing uniform amounts of additive to each coil in the radiation stage of the furnace which is preferably held at a temperature ranging from about 550° to about 1000° C. Additive mixture expenditure into the furnace is preferably regulated in a range of about 0.1 to about 500 parts by weight, more preferably about 0.5 to about 100 parts by weight, of Group IIA metal per million parts of feedstock, dependent upon the differential pressure of the coil. For example, when the differential pressure of the coil is raised about 0.1 to about 0.2 kg/cm$^2$ above the initial pressure, the differential pressure across the clean coil at the commencement of the operation, an automatic increase of additive mixture is preferably effected to reduce the coke build-up within the coil. The maximum amount of the additive mixture is preferably limited to the above amounts because corrosion tends to become a problem at higher concentrations. This method of feeding the additive mixture into the furnace eliminates potential negative effects, such as those arising from deposition of the salts on the metal structure and from the excessive accumulation of salts on the coil, and it permits control of the pyrolysis process.

The present process is conveniently carried out by introducing from about 0.1 to about 500 parts by elemental weight of the Group IA metal, Group IIA metal and the boron in the metal salts and boron acid or boron acid salt of the mixture into one million parts by weight of the hydrocarbon feedstock. An especially preferred weight ratio is from about 0.1 to about 100 parts by weight of the Group IA metal, Group IIA metal and boron to one million parts by weight of the hydrocarbon feedstock.

One skilled in the art can, using the preceding description, utilize the present invention to its fullest extent. The following preferred specific embodiments are, therefore, to be construed as merely illustrative, and not limitative in any way whatsoever in the following examples as well as the rest of the specification and claims, all temperatures set forth are in degrees Celsius and all parts and percentages are by weight, unless otherwise indicated. The term "ppm" means parts by million by weight.

EXAMPLE 1

Comparative pyrolysis plant runs were made for ethane pyrolyzed in an industrial furnace having four pyrolysis coils and having a total rated capacity of 8,000 kg hydrocarbon feedstock/hr. The exit temperature from each coil was 850° C.

In the plant run made without the additive mixture, sufficient steam was added to the ethane to produce a hydrocarbon/steam mixture that contained 30% by weight steam. The differential pressure across the pyrolysis coils at an ethylene load of 2000 kg/hr/coil and a steam load of 600 kg/hr/coil was approximately 1.5 kg/cm$^2$. Formation of coke was indicated by an increase in differential pressure across the pyrolysis coils as the runs progressed. After 40 days of operation, there was a need to de-coke the coils.

Significant levels of coke had formed on the inner surfaces of portions of the coils' wall, and appreciable amounts of CO and $CO_2$ were produced when the coils were de-coked.

A comparative 180 day pyrolysis plant run was also conducted under the same conditions as the first plant run, except that an additive mixture was introduced by means of an aqueous-based solution into the ethane-steam feed mixture. The additive mixture employed during the run was as follows: 92 wt. % calcium acetate and 3 wt. % potassium carbonate and 5 wt. % ammonium borate. The salt mixture was introduced at a concentration of 1–50 ppm during startup and was maintained at this level throughout the run, since no noticeable increase in differential coil pressure was observed over the course of the run. Moreover, during the 180 day run, the quantity of steam was set such that the hydrocarbon/steam mixture consisted of 20 wt. % steam.

As a result of these changes, the ethylene output for the pyrolysis furnace was 1.5% higher than that obtained without additives. Moreover, the presence of ammonium sulfide in the additive mixture lowered the formation of CO to a level comparable to that formed in the absence of the additive mixture. This effect can be seen in Table 1. Table 1 illustrates the composition of the pyrogas, i.e. product, at the point of discharge from the furnace. Data to the left under column A represents the product yield of the furnace run with the additive mixture. Data to the right under column W/OA represents product yield of the furnace run without the additive mixture.

TABLE 1

| Indicator | FURNACE RUN, DAYS 1 day | 40* | 120 | 180 |
|---|---|---|---|---|
| Temperature °C. | 855/855 | 855/855 | 855 | 855 |
| Yield, % mass** | A W/OA | A W/OA | A | A |
| $H_2$ | 3.8/3.85 | 3.5/3.43 | 3.73/— | 3.9/— |
| $CH_4$ | 3.4/3.42 | 3.52/3.6 | 3.50/— | 3.3/— |
| $C_2H_2$ | 0.21/0.21 | 0.25/0.27 | 0.23/— | 0.25/— |
| $C_2H_4$ (ethylene) | 48.7/49.0 | 48.5/46.3 | 49.0/— | 48.87/— |
| $C_2H_6$ (ethane) | 39.4/38.8 | 38.8/39.8 | 38.4/— | 39.2/— |
| $C_3H_6$ | 1.03/1.08 | 1.10/0.93 | 1.17/— | 1.12/— |
| $C_3H_8$ | 0.22/0.23 | 0.18/0.24 | 0.23/— | 0.21/— |
| $C_4H_6$ | 1.14/1.08 | 1.20/1.11 | 1.03/— | 1.08/— |
| $C_4H_{10}$ | 0.28/0.31 | 0.29/0.25 | 0.28/— | 0.27/— |
| $C_5$ | 1.61/1.82 | 2.42/3.90 | 2.24/— | 1.65/— |
| CO | 0.11/0.10 | 0.11/0.095 | 0.11/— | 0.10/— |
| $CO_2$ | 0.05/0.043 | 0.11/0.095 | 0.04/— | 0.043/— |

*Furnace without additive mixture was shut down after 40 days for coke burning.
**Percentage of product yield from feedstock No significant amount of coke collected in the coils during any portion of the 180 days plant pyrolysis run of continuous operation, and no substantial change in the pressure across the pyrolysis coils was observed. No evidence of corrosion was seen upon visual inspection of sections of the coils upon completion of the 180 day run.

The above method of this example can be run with similar results by using in place of calcium acetate: magnesium acetate or barium acetate.

Similar results can be obtained in the above exemplified process by employing one or more, as a mix, of the following salts in place of potassium carbonate: potassium acetate or potassium silicate.

Ammonium borate can be replaced with ammonium meta borate, ammonium tetraborate (aka ammonium pyroborate), ammonium polyborate, orthoboric acid, metaboric acid, tetraboric acid and polyboric acid in the above exemplified process with similar results.

EXAMPLE 2

Comparative pyrolysis plant runs were made using a commercial pyrolysis furnace having four coils and a total rated capacity of 10,000 kg hydrocarbon feedstock/hr. The nominal temperature of operation was 840° C. The pyrolysis was carried out with a 50 wt. % steam load. Naphtha with an initial boiling point of 35° C. and final boiling point of 185° C. was used as the hydrocarbon feedstock. The composition of the naphtha was a follows: aliphatic hydrocarbons, 46.0 wt. %; aromatic hydrocarbons, 5.68 wt. %; cyclic paraffins, 48.24 wt. %; and sulfur 0.046 wt. %.

In the plant run, made without the additive mixture, at a feed rate of 5000 kg naphtha/hr/coil, the pressure drop across each coil was initially 1.4 kg/cm$^2$. As the pyrolysis furnace was operated, the pressure drop increased due to the buildup of coke in the coils. Eventually after about 40 days, significant coke deposits had developed in the coils and the pyrolysis furnace had to be shut down and de-coked.

A comparative plant run was conducted under the same conditions as the first plant run except that an aqueous-based additive mixture was added to the feed mixture. The composition of the additive mixture was 88 wt. % calcium acetate; 7 wt. % potassium acetate and 5 wt. % ammonium borate.

The additive mixture was injected to produce 5–50 ppm of additive mixture in the hydrocarbon feedstock. The addition of the mixture allowed a thirty percent (30%) reduction in steam flow.

Over a 180 days run, the pressure drop remained essentially constant across the coils, and ethylene and propylene production was about 2% higher than that of the run made without the additive mixture. Since there was no need to shut down the unit for 180 days, the run extended about 3.3 times longer than the run without additives. The shutdown after 180 days was necessitated by coke formation in the TLX tubes. Essentially, no coke was found in any of the coils of the furnace. Upon completion of the run, the coil and TLX tubes were inspected. No corrosion problems were noted.

Table 2 illustrates the composition of the product gas at the point of discharge from the furnace. Data to the left under column A represents the product yield of the furnace with the additive mixture. Data to the right under column W/OA represents product yield of the furnace without the additive mixture.

TABLE 2

| Indicator | FURNACE RUN, DAYS 1 day | 40* | 120 | 180 |
|---|---|---|---|---|
| Temperature °C. | | | | |
| Yield, % mass** | A W/OA | A W/OA | A | A |
| $H_2$ | 0.98/0.92 | 1.10/1.05 | 1.01/— | 1.06/— |
| CO | 0.09/0.080 | 0.10/0.098 | 0.11/— | 0.11/— |
| $CO_2$ | 0.06/0.064 | 0.06/0.068 | 0.06/— | 0.06/— |
| $CH_4$ | 15.4/15.7 | 15.5/16.1 | 15.6/— | 15.5/— |
| $C_2H_6$ | 4.5/4.6 | 4.50/4.70 | 4.50/— | 4.60/— |
| $C_2H_4$ (ethylene) | 26.5/25.7 | 26.8/25.3 | 27.3/— | 27.4/— |
| $C_3H_8$ | 0.52/0.50 | 0.50/0.53 | 0.53/— | 0.48/— |
| $C_3H_6$ (propylene) | 15.2/14.8 | 15.3/14.5 | 15.8/— | 16.01/— |
| $C_4H_{10}$ | 0.44/0.48 | 0.49/0.48 | 0.46/— | 0.48/— |
| $C_3H_4$ (allene) | 0.34/0.33 | 0.32/0.38 | 0.38/— | 0.37/— |
| $C_3H_4$ (methylac.) | 0.21/0.19 | 0.23/0.20 | 0.22/— | 0.23/— |
| $C_2H_2$ | 0.57/0.50 | 0.52/0.55 | 0.48/— | 0.51/— |
| $C_4H_8$ | 4.30/4.28 | 4.25/4.21 | 3.80/— | 4.10/— |
| $C_4H_6$ | 3.80/4.05 | 3.83/3.90 | 4.03/— | 4.10/— |
| Pyrobenzine | 21.79/22.66 | 21/16/22.02 | 20.52/— | 19.69/— |
| Heavy resin initial boiling T>200° C. | 5.3/5.6 | 5.4/5.8 | 5.4/— | 5.4/— |

*Furnace without the additive mixture is shut down after 40 days for coke burning.
**Percentage of product yield from feedstock Similar results can be obtained by replacing ammonium borate with ammonium tetraborates, potassium borate, potassium metaborate, potassium tetraborate, or boric acid.

EXAMPLE 3

Comparative pyrolysis plant runs were made using a gas oil with a density of 0.81 g/cm$^3$. The gas oil had a boiling point range from 180° to 345° C. and contained, by weight, 26.00 wt. % aromatics, 34.00% cyclic paraffins, 26.13% isoparaffins, 13.58% n-paraffins, and 0.31% sulfur in sulfur-containing hydrocarbons. The furnace had four coils and a rated total capacity of 10,000 kg hydrocarbon feedstock/hr. Pyrolysis was conducted at an exit temperature of 820° C. Runs were conducted with a gas oil flow rate of 2500 kg gas oil/hr/coil and steam flow rates of 2000 kg steam/hr/coil (with additive) and 2500 kg steam/hr/coil (without additive).

The run without the additive mixture had to be curtailed after 40 days for furnace de-coking. For the run with the additive mixture, the following additive mixture was used (as expressed on a weight basis): 88.9 wt. % calcium nitrate; 6.1 wt. % equal parts potassium carbonate and 5 wt. % ammonium borate.

The amount of additives employed in ppm of the hydrocarbon feedstock were varied as desired between 0.5 to 40. The flow rate of additives was adjusted to control the pressure drop at a constant value throughout the entire run.

Whenever the pressure drop in the coil increased substantially, the rate of additive mixture flow was increased to obtain a higher ppm of additives in the feedstream. After 90 days of operation, the unit was shut down for survey. Even with the reduced steam flow, no evidence of coke formation in the coils was found; in addition, no coil corrosion was noted.

Further results are presented in Table 3. Table 3 illustrates the composition of the pyrogas at the point of discharge from the furnace. Data to the left under column A represents the product yield for the furnace with the additive mixture. Data to the right under column W/OA represents product yield for the furnace without the additive mixture.

TABLE 3

| Indicator | FURNACE RUN, DAYS 1 day | 40* | 60 | 90 |
|---|---|---|---|---|
| Temperature °C. | 820/820 | 820/820 | 820/— | 820/— |
| Yield, % mass** | A W/OA | A W/OA | A | A |
| $H_2$ | 0.77/0.72 | 0.81/0.69 | 0.85/— | 0.84/— |
| CO | 0.10/0.093 | 0.11/0.09 | 0.11/— | 0.11/— |
| $CO_2$ | 0.072/0.06 | 0.08/0.07 | 0.08/— | 0.078/— |
| $CH_4$ | 11.0/10.3 | 11.1/10.5 | 11.0/— | 11.5/— |
| $C_2H_6$ | 3.4/3.5 | 3.34/3.45 | 3.5/— | 3.5/— |
| $C_2H_4$ (ethylene) | 24.4/22.2 | 24.8/22.6 | 24.6/— | 24.6/— |
| $C_3H_8$ | 0.35.0.4 | 0.39/0.43 | 0.39/— | 0.41/— |
| $C_3H_6$ (propylene) | 13.0/12.7 | 13.1/12.5 | 13.0/— | 13.11/— |
| $C_4H_{10}$ | 0.3/0.28 | 0.32/0.3 | 0.28/— | 0.32/— |
| $C_3H_4$ (allene) | 0.31/0.32 | 0.28/0.32 | 0.32/— | 0.32/— |
| $C_3H_4$ (methylac.) | 0.34/0.31 | 0.33/0.28 | 0.32/— | 0.35/— |
| $C_2H_2$ | 0.42/0.4 | 0.44/0.42 | 0.40/— | 0.39/— |
| $C_4H_8$ | 5.02/5.1 | 4.89/5.1 | 4.8/— | 4.77/— |
| $C_4H_6$ | 4.08/4.1 | 4.32.4.2 | 4.12/— | 4.21/— |
| Pyrobenzene | 14.8/17.7 | 15.2/17.8 | 15.6/— | 15.6/— |
| Heavy resin initial boiling T>200° C. | 21.6/21.8 | 20.5/21.57 | 20.63/— | 20.7/— |

*Furnace without the additive mixture is shut down for coke burning.
**Percentage of product yield from feedstock

EXAMPLE 4

Table 4 represents the comparative data for pyrolysis runs for naphtha, both with and without the additive mixture. The runs were under conditions similar to, and the additive mixture proportions were the same as, those discussed in Example 2. Flow rates were 5000 kg/naphtha/coil and 3000 kg steam/hr/coil (without additive mixture) and 5000 kg naphtha/hr/coil and 1900 kg steam/hr/coil (with additive mixture). Temperature upon exit from the furnace was 835° C. The additive mixture was the same as used in Example 2. The level of additives used during the course of the additive mixture run varied from about 5–20 ppm of feedstock, depending upon the differential pressure across the pyrocoil. Table 4 illustrates the composition of the product stream at the point of discharge from the furnace. Data to the left under column A represents the product yield of the furnace with the additive mixture. Data to the right under column W/OA represents the product yield of the furnace without the additive mixture.

TABLE 4

| Furnace run, days | TEMPERATURE °C. T upon discharge from furnace | After TLX*A | After TLX*B | Walls flow I | Walls flow II | Walls flow III | Walls flow IV | Differential pressure kg/cm² |
|---|---|---|---|---|---|---|---|---|
| | A W/OA | A | A | A | A | A | A | A/WOA |
| 1 | 835/835 | 373/372 | 367/372 | 943/940 | 944/943 | 945/945 | 943/945 | 1.25/1.34 |
| 10 | 835/835 | 374/387 | 373/393 | 944/952 | 946/955 | 947/955 | 945/963 | 1.32/1.42 |
| 30 | 835/835 | 377/434 | 384/440 | 945/970 | 948/965 | 945/975 | 944/968 | 1.28/1.52 |
| | | | | | | | | 1.24/1.62 |
| 40 | 835/835 | 380/453 | 376/460 | 950/1043 | 945/1033 | 952/1037 | 950/1052 | 1.27/1.80 |
| 70 | 835/— | 386/— | 390/— | 952/— | 950/— | 957/— | 960/— | 1.32/— |
| 130 | 835/— | 412/— | 421/— | 950/— | 952/— | 953/— | 951/— | 1.27/— |
| 180 | 835/— | 430/— | 437/— | 947/— | 953/— | 950/— | 950/— | 1.26/— |

Without the additive mixutre, the furnace had to be de-coked after 40 days of operation, whereas the furnace operated for 180 days with the additive mixture disclosed in Example 2. Even after 180 days, no coke had formed in the coils.

The outer wall temperatures presented in Table 4 were measured using a pyrometer. No substantial change in the temperature of the coil walls of the furnace was noted using the additive mixture throughout the 180 day run. In the run where no additive mixture was used, a steady elevation in temperature was observed, which reached a maximum after 40 days of run time. As the temperature of the coil walls increased, the differential pressure across the coils increased as well. Both effects indicate the laydown of coke deposits on the inner tubular walls of the coils.

Moreover, as seen from Example 4 (and the preceding examples), the use of the additive mixture increases furnace run time by a factor of about 3 to 4. The output of high pressure steam from the heat exchangers of the TLX was also seen to increase by about 30% due to the lowered (2–3 times lower) rate of coke and resin formation in the heat exchanger tubes.

The additive mixture also effectively reduces coke deposition in the TLX's, especially in the inlet portion of the unit.

In Example 4, the inlet (high temperature) portion and up to 60–70% of the TLX's were completely free of coke during the entire 180 day run. Toward the exit (low temperature) portion of the TLX, small coke deposits were found. These coke deposits were analyzed upon completion of the 180 day study. The results are shown in Table 5, wherein the upper data represents the furnace run with additive mixture and the lower data represents the furnace run without additive mixture.

TABLE 5

| | Ca Content in terms of CaO, % mass | Fe Content in terms of $Fe_2O_3$, % mass | Cr Content in terms of $Cr_2O_3$, % mass | Ni Content in terms of NiO, % mass | Carbon Content % mass |
|---|---|---|---|---|---|
| With additive mixture | 6.5 | trace | trace | trace | 83.5 |
| Without additive mixture | trace | 3.4 | 0.054 | 0.032 | 86.51 |

As is apparent from the data in Table 5, the Ca content in terms of CaO is increased in the furnace using additive mixture from trace to 6.5%, indicating the presence of Ca in the TLX and its activity in the coke gasification reaction.

Moreover, the absence of Fe, Cr and Ni in the coke deposits of the furnace using the additive mixture indicates an absence of corrosion in the pyrocoils and tubes of the TLX.

EXAMPLE 5

The pyrolysis plant run exemplified in Example 2 can be run with the additive mixture dispersed in naphtha at a concentration of from one milligram to 1000 milligrams of the additive mixture per liter of naphtha. The naphtha based additive mixture can be added to the coils at the rate of from 0.1 to 500 ppm by weight of calcium, potassium and boron to the naphtha hydrocarbon feedstock in the coils. The rate of addition of the naphtha based additive mixture will be adjusted so that the pressure drop across each coil remains substantially the same and the skin temperature of the coil remains substantially the same during the pyrolysis plant run.

EXAMPLE 6

The process of Example 1 can be run with the exception that the aqueous based additive mixture is replaced with a dry finely ground additive mixture injected into the coils with ethane gas. The rate of injection is controlled initially to provide from about 0.1 to about 500 ppm by weight calcium per $10^6$ ppm ethane hydrocarbon feedstock in the coils. Thereafter the rate of injection of the dry additive mixture is controlled to maintain a constant pressure drop across the coils and to maintain a constant skin temperature for the coils. As the pressure drop increases or the skin temperature increases, the amount of additive mixture is increased until the pressure drop and/or skin temperature again reach a constant level.

EXAMPLE 7

The process of Example 3 can be repeated by employing an additive mixture dissolved in water to give a concentration of from one to 10,000 milligrams of the additive mixture per liter of solution. Similar results can be obtained by dispersing the additive mixture in a aqueous slurry of 50% water and 50% gas oil by weight. The solvent based additive mixture is added to the gas oil hydrocarbon feedstock in the coil at a rate, initially, of from about one to about 1000 milligrams per liter of hydrocarbon feedstock. Thereafter, the amount of additive mixture is adjusted to maintain the pressure drop across the coils and the skin temperature of the coils at a constant temperature. When the pressure drop increases and/or the temperature increases, the additive rate of the additive mixture is increased.

From the foregoing description, one skilled in the art can easily ascertain the essential characteristics of the invention, and without departing from the spirit and scope thereof, can make various changes and modifications of the invention to adapt it to various usages and conditions.

EXAMPLE 8

The process of Example 1 is repeated except that 99.86 weight percent of calcium acetate, 0.004 weight percent of potassium carbonate, and 0.136 weight percent of ammonium borate is employed to give an elemental weight ratio of Group IA metal to Group IIA metal in the mixture of 0.01 and an elemental weight ratio of boron to the Group IA metal and the Group IIA metal in the mixture of about 0.001.

EXAMPLE 9

The methods of Example 2 can be run wherein the additive mixture contains 0.50 weight percent calcium acetate, 7.26 weight percent potassium acetate, and 92.24 weight percent ammonium borate to yield a mixture having an elemental weight ratio of the Group IA metal to the Group IIA metal of 5.0 and an elemental weight ratio of the boron to the Group IA metal and the Group IIA metal of 5.0.

EXAMPLE 10

The process of Example 3 can be run applying 41.66 weight percent of potassium metasilicate to yield an elemental weight ratio of silicon to the Group IA metal, Group IIA metal and boron of 0.5. If 0.14 weight percent of potassium metasilicate is employed, the elemental weight ratio is reduced to 0.001. If 58.8 weight percent of potassium metasilicate is employed in the additive mixture, the elemental weight ratio is increased to 1.0.

We claim:

1. A method for inhibiting the formation and deposition of coke on the coil of a pyrolysis furnace having a radiation stage and convection stage during high temperature processing of hydrocarbon feedstock for the production of ethylene while minimizing corrosion of the coils which comprises: adding to the hydrocarbon feedstock in the coil at the end of the convection stage of the pyrolysis furnace a coke inhibiting amount of a mixture of a Group IA metal salt, a Group IIA metal salt, a boron acid or salt thereof and a silicon compound.

2. The method according to claim 1 wherein the hydrocarbon feed has a temperature of at least 500° C. when injected with the mixture.

3. The method according to claim 1 wherein about 0.1 to about 500 ppm by weight of Group IIA metal in the mixture is added to the hydrocarbon feedstock.

4. The method according to claim 3 wherein the elemental weight ratio of the Group IA metal to the Group IIA metal in the mixture is from about 0.001 to about 5.0.

5. The method according to claim 1 wherein about 0.5 to about 100 ppm by weight of a Group IIA metal in the mixture is added to the hydrocarbon feedstock.

6. The method according to claim 5 wherein the elemental weight ratio of the Group IA metal to the Group IIA metal in the mixture is from about 0.007 to about 3.0.

7. The method according to claim 3 wherein the elemental weight ratio of the boron in the boron acid or salt to the Group IA metal and Group IIA metal in the mixture is from about 0.001 to about 5.0.

8. The method according to claim 5 wherein the elemental weight ratio of the boron in the boron acid or salt to the Group IA and Group IIA metal in the mixture is from about 0.005 to about 3.0.

9. The method according to claim 1 wherein the mixture is dissolved in a solvent and the solvent dissolved mixture is injected into the hydrocarbon feed.

10. The method according to claim 9 wherein the solvent is selected from water, alcohols, polyols, and hydrocarbons.

11. The method according to claim 9 wherein the mixture is fully dissolved in the solvent.

12. The method according to claim 11 wherein the solvent is water.

13. The method according to claim 11 wherein the solvent contains up to one gram per liter of solvent of the Group IA metal salt, Group IIA metal salt and boron acid or salt.

14. The method according to claim 13 wherein the solvent is water.

15. The method according to claim 9 wherein a portion of the mixture is dissolved in the solvent and the remainder of the mixture is finely dispersed as undissolved solids in the solvent.

16. The method according to claim 15 wherein the solvent is selected from the group consisting of water, alcohol, polyols and hydrocarbons.

17. The method according to claim 1 wherein the amount of mixture injected into the hydrocarbon feedstock is increased when the outer wall temperature of the coil in the radiation stage of the pyrolysis furnace increases.

18. The method according to claim 1 wherein the amount of the mixture injected into the hydrocarbon feedstock is increased when the pressure drop in the coil increases.

19. The method according to claim 1 wherein the hydrocarbon feedstock is selected from lower alkanes, naphtha, gas oil, heavier oil or mixtures thereof.

20. The method according to claim 1 wherein the hydrocarbon feedstock is mixed with steam in the convection stage.

21. The method according to claim 1 wherein the Group IA metal salt is potassium acetate, potassium metaborate, potassium metasilicate, potassium carbonate, potassium silicotungstate, potassium nitrate, or mixtures thereof.

22. The method according to claim 1 wherein the Group IIA metal salt is the calcium acetate, magnesium acetate, barium acetate, calcium, magnesium and barium salts of alkanoic acids or mixtures thereof.

23. The method according to claim 1 wherein the weight ratio of the mixture to the hydrocarbon feedstock is from about 0.1 to about 5000 parts by weight of the Group IA metal, Group IIA metal and boron in the mixture per one million parts by weight of hydrocarbon feedstock.

24. The method according to claim 23 wherein the elemental weight ratio of boron to the Group IA metal and Group IIA metal in the mixture is from about 0.001 to about 5.0 and an elemental weight ratio of the Group IA metal to the Group IIA metal is from about 0.001 to about 5.0.

25. The method according to claim 23 wherein the elemental weight ratio of boron to the Group IA metal and Group IIA metal in the mixture is from about 0.005 to about 3.0 and elemental weight ratio of the Group IA metal to the Group IIA metal is from about 0.007 to about 3.0.

26. The method according to claim 1 wherein the weight ratio of the mixture to the hydrocarbon feedstock is from about 0.1 parts to about 500 parts by weight of the Group IA metal, Group IIA metal and boron in the mixture per one million parts by weight of hydrocarbon feedstock.

27. The method of claim 1, wherein said additive mixture is dissolved in a solvent with the concentration of Group IIA metal salts in the solvent equaling 10 g. or less per liter of solvent.

28. The method of claim 1 wherein the boron acid or salt is ortho-, meta- or tetraboric acid, polyboric acid or the ammonium, Group IA metal or Group IIA metal salt thereof.

29. The method according to claim 1 wherein the elemental weight ratio of the silicon in the silicon compound to the Group IA metal, Group IIA metal and boron is from about 0.001 to about 1.0.

30. The method according to claim 1 wherein the silicon compound is a potassium salt of silicic acid, a silane, or an alkyl and/or aryl substituted silane.

31. A method for inhibiting the formation and deposition of coke on the coil of a pyrolysis furnace having a radiation stage and convection stage during high temperature processing of hydrocarbon feedstock for the production of ethylene while minimizing corrosion of the coils which comprises: adding to the hydrocarbon feedstock in the coil at the end of the convection stage at the pyrolysis furnace a coke inhibiting amount of a mixture of potassium acetate, calcium acetate and ammonium borate.

32. The method according to claim 31 wherein the mixture contains a silicon compound.

* * * * *